US006397729B1

(12) United States Patent
Dexter et al.

(10) Patent No.: US 6,397,729 B1
(45) Date of Patent: Jun. 4, 2002

(54) HIGH PRESSURE PUMP HAVING BEARING ASSEMBLY PRE-LOAD APPARATUS

(75) Inventors: Shane Dexter, Humboldt; Allen Palmer, Lexington; Mark Wood, Jackson, all of TN (US)

(73) Assignee: DeVilbiss Air Power Company, Jackson, TN (US)

( * ) Notice: Subject to any disclaimer, the term of this patent is extended or adjusted under 35 U.S.C. 154(b) by 18 days.

(21) Appl. No.: 09/639,572

(22) Filed: Aug. 14, 2000

(51) Int. Cl.[7] ..... F01B 7/00
(52) U.S. Cl. ..... 92/150
(58) Field of Search ..... 92/150

(56) References Cited

U.S. PATENT DOCUMENTS 4,813,342 A * 3/1989 Schneider et al. ..... 92/207
5,533,425 A * 7/1996 Mabee ..... 74/661
5,857,396 A * 1/1999 Strouse, Jr. ..... 83/502

* cited by examiner

*Primary Examiner*—Kevin Lee
(74) *Attorney, Agent, or Firm*—Suiter & Associates PC; Kevin E. West

(57) ABSTRACT

An apparatus is described for capturing a bearing assembly in a device such as a high pressure pump or the like so that undesired pre-load within the bearing assembly is substantially reduced or eliminated. The apparatus is comprised of a fastener for capturing the bearing assembly by securing the bearing assembly to the shaft of the pump's eccentric assembly. A collet is disposed in the bearing assembly around the fastener. The fastener includes a tapered section for at least partially expanding the collet so that the collet engages the bearing assembly capturing the bearing assembly and controlling the amount of pre-load placed thereon.

20 Claims, 6 Drawing Sheets

HIGH PRESSURE PUMP HAVING BEARING ASSEMBLY PRE-LOAD APPARATUS

CROSS REFERENCE TO RELATED APPLICATIONS

The present application is related to co-pending U.S. application Ser. No. 09/639,573, filed Aug. 14, 2000. Said U.S. patent application Ser. No 09/639,573 is herein incorporated by reference in its entirety.

The present application is further related to co-pending U.S. patent application Ser. No. 09/639,435 filed Aug. 14, 2000. Said U.S. patent application Ser. No. 09/639,435 is herein incorporated by reference in its entirety.

FIELD OF THE INVENTION

The present invention generally relates to the field of high pressure pumps suitable for use in devices such as pressure washers and the like that are capable of delivering a fluid from a supply source and discharging it at a greater pressure, and more particularly to apparatus for eliminating undesired pre-load within the bearing assemblies of such pumps.

BACKGROUND OF THE INVENTION

High pressure washing devices, commonly referred to as pressure washers, deliver a fluid, typically water, under high pressure to a surface to be cleaned, stripped or prepared for other treatment. Pressure washers are produced in a variety of designs and can be used to perform numerous functions in industrial, commercial and home applications. Pressure washers typically include an internal combustion engine or electric motor that drives a pump to which a high pressure spray wand is coupled via a length of hose. Pressure washers may be stationary or portable. Stationary pressure washers are generally used in industrial or commercial applications such as car washes or the like. Portable pressure washers typically include a power/pump unit that can be carried or wheeled from place to place. A source of water, for example, a garden hose, is connected to the pump inlet, and the high pressure hose and spray wand connected to the pump outlet.

Typically, pressure washers utilize a piston pump having one or more reciprocating pistons for delivering liquid under pressure to the high pressure spay wand. Such piston pumps often utilize two or more pistons to provide a generally more continuous spay, higher flow rate, and greater efficiency. Typically, the pistons of such pumps are driven at a high rate of speed placing stress on the bearings within the pump's shaft and eccentric assemblies. Consequently, it is desirable to reduce or eliminate excessive loading of these bearings to prevent their premature wear and/or failure.

SUMMARY OF THE INVENTION

Accordingly, the present invention is directed to apparatus for capturing a bearing assembly in a device such as a high pressure pump, or the like, so that undesired pre-load within the bearing assembly is substantially reduced or eliminated. In an exemplary embodiment, the apparatus of the present invention is comprised of a fastener for capturing the bearing assembly by securing the bearing assembly to a shaft, such as the shaft of a high pressure pump's eccentric assembly wherein the shaft is suitable for being coupled to the drive shaft of an engine. A collet is disposed in the bearing assembly around the fastener. The fastener includes a tapered section for at least partially expanding the collet so that the collet engages the bearing assembly capturing the bearing assembly and controlling the amount of pre-load placed thereon.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
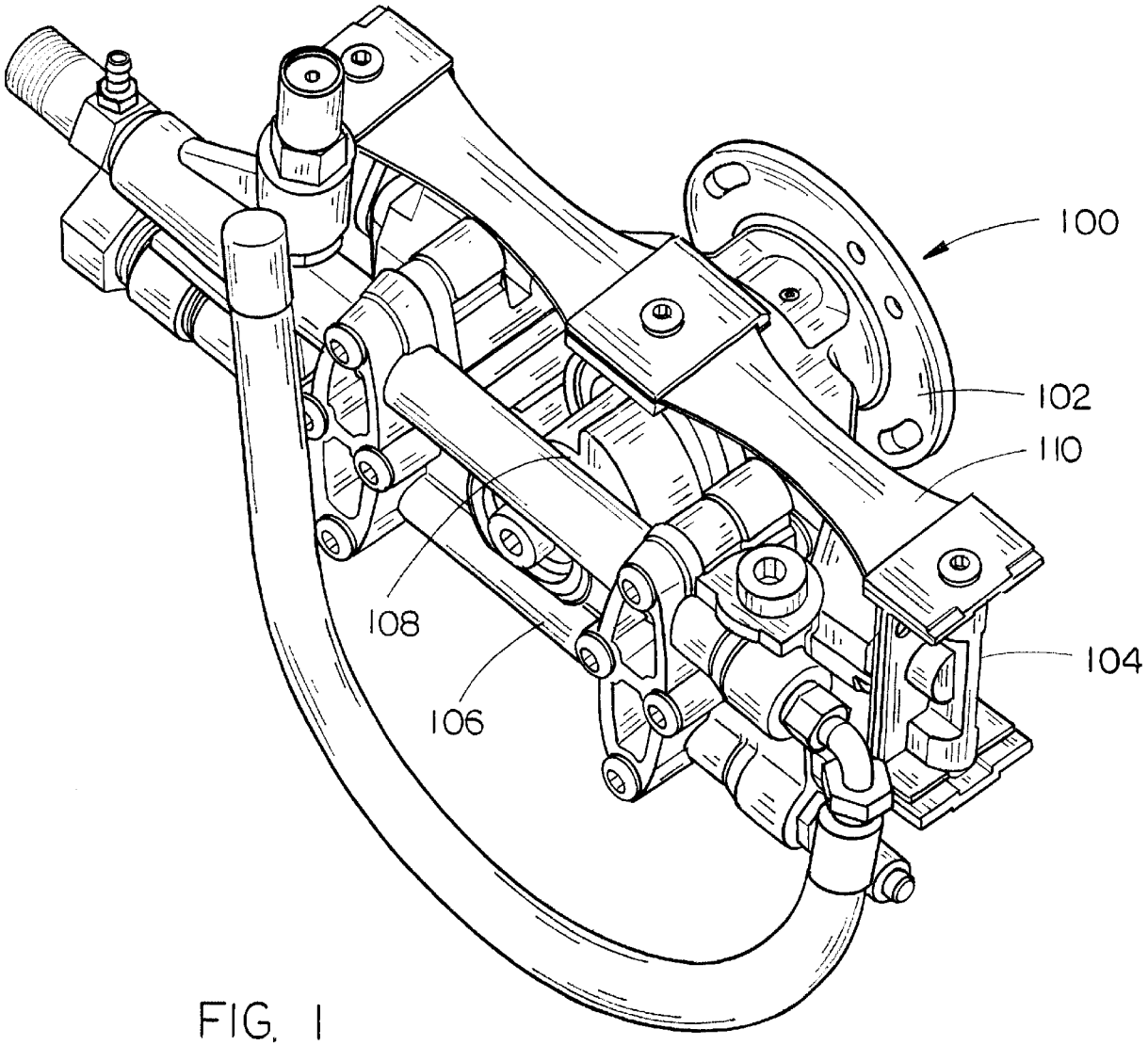
FIG. 1 is an isometric view of an oilless high pressure pump in accordance with an exemplary embodiment of the present invention.

Reference will now be made in detail to the presently preferred embodiments of the invention, examples of which are illustrated in the accompanying drawings.

Referring generally to FIGS. 1 through 6, an oilless high pressure pump having a bearing capture apparatus in accordance with an exemplary embodiment of the present invention is described. The pump 100 is comprised of a pump assembly 102 supporting one or more piston assemblies 104 suitable for pumping a liquid such as water, or the like and a manifold or head assembly 106, coupled to the pump assembly 102, for porting the liquid to and from the piston assemblies 104. In accordance with the present invention, an eccentric assembly 108 converts rotary motion of the rotating shaft of an engine (not shown) to rectilinear motion for reciprocating the piston assemblies 104. Flexible straps 110 couple the eccentric assembly 108 to the piston assemblies 104 to communicate the rectilinear motion of the eccentric assembly 108 to the piston assemblies 104 to pump the liquid. In exemplary embodiments, the eccentric assembly 108 employs sealed, deep grooved permanently lubricated bearing assemblies.

In accordance with an exemplary embodiment of the present invention, bearing capture apparatus 112 is comprised of a fastener 114 and collet 116 for capturing bearing assembly 118 by securing the bearing assembly 118 to the pump's eccentric assembly 108. The collet 116 is disposed within the bearing assembly 118 around the fastener 114. When tightened, the fastener 114 at least partially expands the collet 116 axially, causing the collet 116 to engage and capture the bearing assembly 118. In this manner, the amount of pre-load placed on the bearing assembly 118 is controlled.

Figure 2:
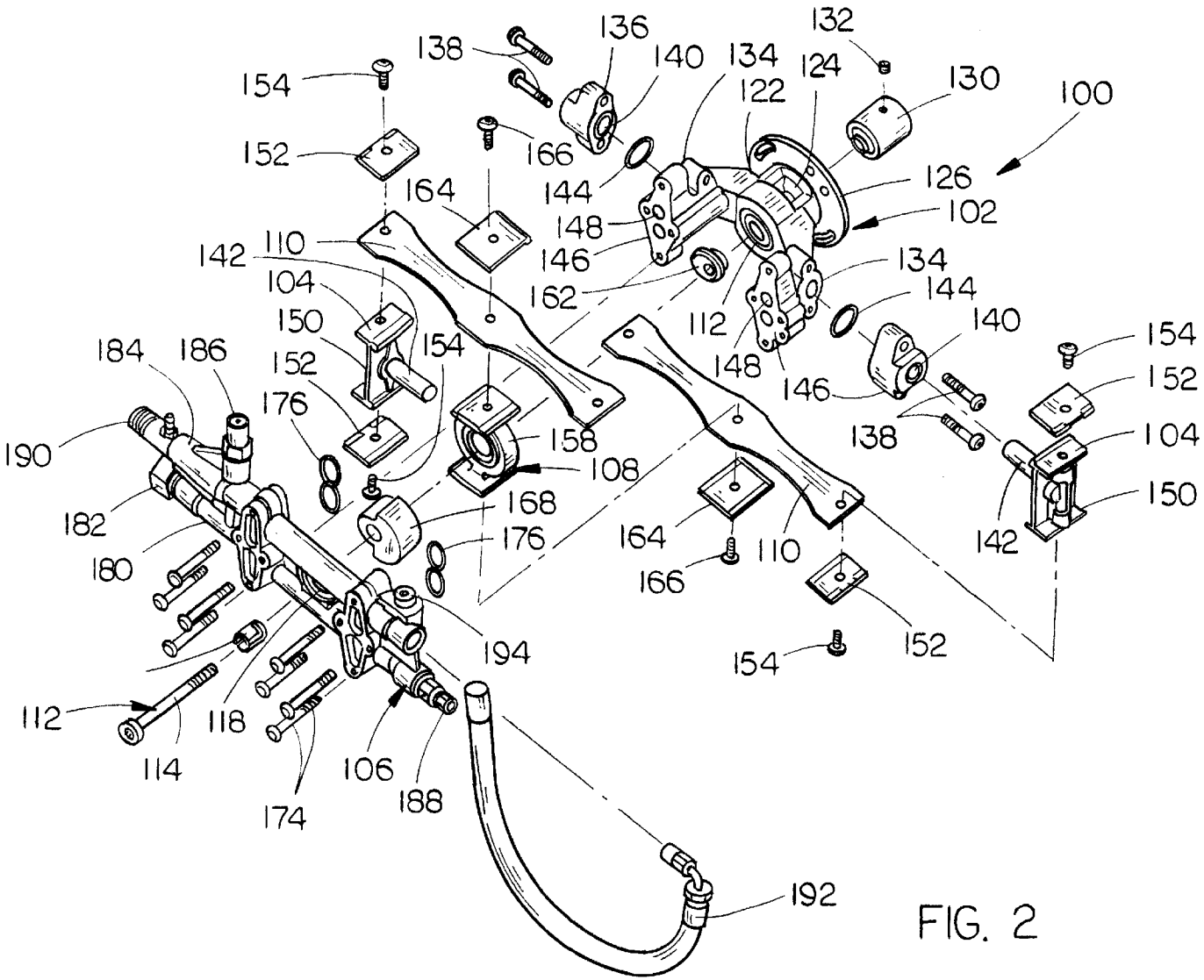
FIG. 2 is an exploded isometric view of the pump shown in FIG. 1 further illustrating the component parts of the pump.
Figure 3:
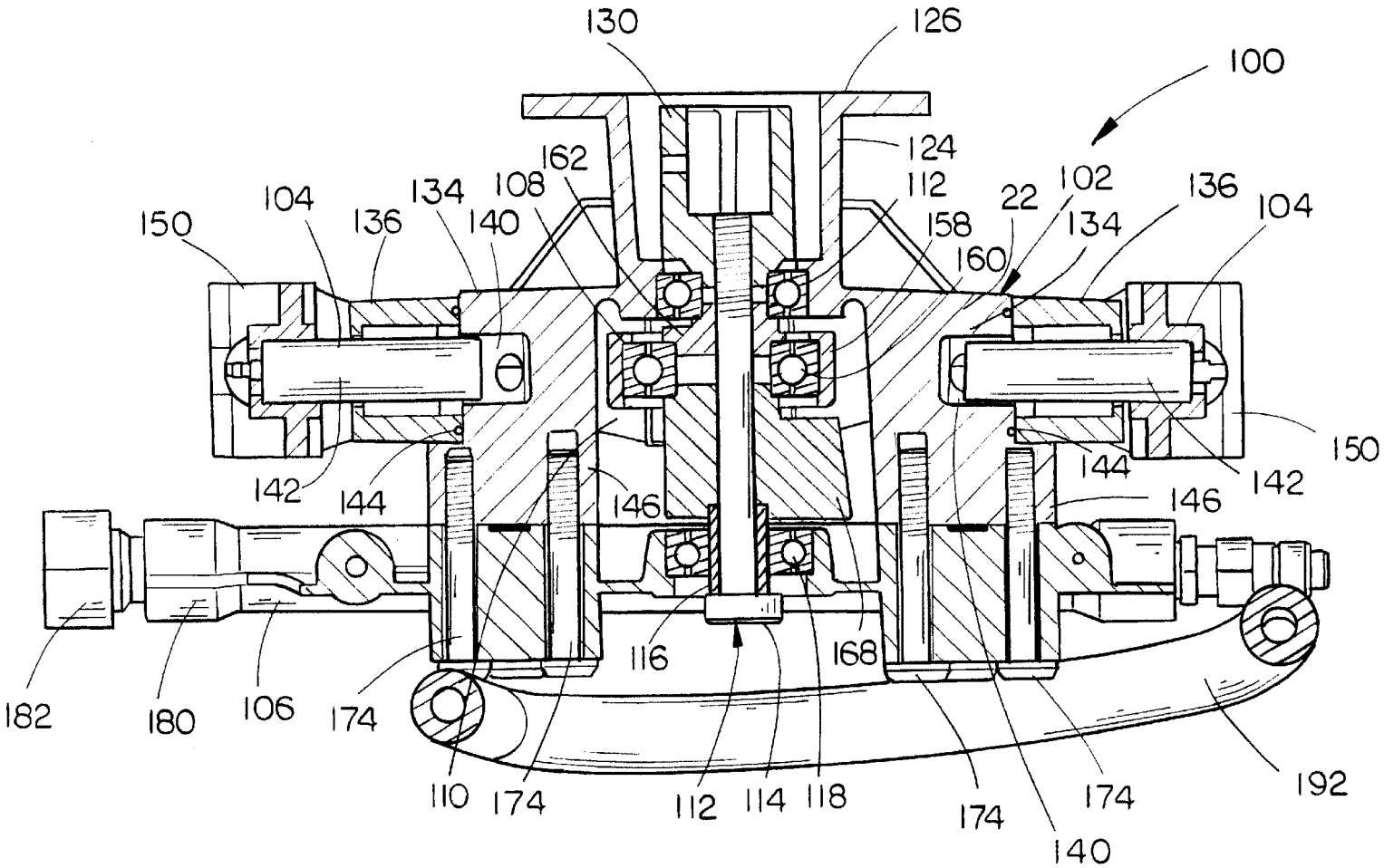
FIG. 3 is a cross-sectional view of the pump shown in FIG. 1, further illustrating the apparatus of the present invention.

Referring now to FIGS. 2 and 3, pump assembly 102 includes a pump body 122 having a shaft mounting portion 124 including a flange 126 suitable for coupling the pump 100 to an engine such as the internal combustion engine or electric motor of a pressure washer. Preferably, bearing assembly 118 is mounted in the shaft mounting portion 124 for supporting shaft 130 which is coupled to the drive shaft of an engine (not shown) via key 132. Pump body 122 may further include axi-linearly opposed cylinder head bosses 134 to which journal bodies 136 are coupled via fasteners 138 to form cylinders 140 in which pistons 142 of piston assemblies 104 may reciprocate. A seal such as an O-ring or the like 144 may be disposed between each cylinder head boss 134 and journal body 136 for preventing leakage of the liquid from the cylinders 140 during operation of the pump 100. Head coupling bosses 146 formed in pump body 122 provide a surface for coupling the head assembly 106 to the pump assembly 102 and include ports 148 for porting the liquid to and from the cylinders 140 and piston assemblies 104.

Each piston assembly 104 includes a strap coupling member 150 mounted to the outer end of piston 142 for coupling the piston 142 to straps 110. In the exemplary embodiment shown, straps 110 are clamped to the strap coupling members 150 by end clamp block 152 and fastener 154. This clamping arrangement allows loads to be more evenly distributed through the ends of straps 110.

In an exemplary embodiment, pistons 142 are formed of a ceramic material. However, it will be appreciated that pistons 142 may alternately be formed of other materials, for example metals such as aluminum, steel, brass, or the like without departing from the scope and spirit of the present invention. Cylinders 140 formed in journal bodies 136 may include a seal providing a surface against which the piston 142 may reciprocate and for preventing liquid within the cylinder 140 from seeping between the piston 142 and cylinder wall. Preferably, the seal is formed of a suitable seal material such as tetrafluoroethylene polymers or Teflon (Teflon is a registered trademark of E. I. du Pont de Nemours and Company), a butadiene derived synthetic rubber such as Buna N, or the like.

In the exemplary embodiment of the invention shown in FIGS. 2 and 3, eccentric assembly 108 includes shaft 130, bearing assemblies 118 & 128, and an eccentric 158. The eccentric 158 is comprised of a ring bearing assembly 160 and a bearing coupling member 162 for coupling the ring bearing assembly 160 to bearing assembly 118. Ring bearing assembly 160 is further coupled to straps 110 via clamp blocks 164 and fasteners 166 which clamp the center of straps 110 to the ring bearing assembly 160. This clamping arrangement allows loads within the center of strap 110 to be distributed more evenly. A counterweight 168 may be provided for balancing movement of the eccentric assembly 108 and piston assemblies 104 to reduce or eliminate vibration of the pump 100 during operation.

Referring now to FIG. 3, eccentric assembly 108 is secured together by fastener 114 of bearing capture apparatus 112. In the exemplary embodiment shown, the fastener 114 extends through bearing assembly 118, counterweight 168, ring bearing assembly 160, bearing coupling member 162, and bearing assembly 118 and is threaded into shaft 130 to clamp the components of the eccentric assembly 108 together. Preferably, fastener 114 is off-centered in bearing coupling member 162 so that the ring bearing assembly 160 is positioned axially off-center with respect to the center of shaft 130 allowing the eccentric 158 to convert the rotary motion of the shaft 130 to rectilinear motion that is communicated to the piston assemblies 104 by straps 110 for reciprocating pistons 142. Collet 116 is engaged within bearing assembly 118 by fastener 114 for capturing and providing the proper pre-loading of bearing assemblies 118 & 128. It will be appreciated that the bearing capture apparatus 112 of the present invention is not limited to use with the instantly described pump, but may instead be adapted for use with pumps utilizing other eccentric assembly configurations as contemplated by those of ordinary skill in the art.

Referring again to FIGS. 2 and 3, head assembly 106 is secured to the head coupling bosses 146 of pump body 122 by fasteners 174. Seals such as a shaped O-ring, gasket, or the like 178 may be disposed between the head assembly 106 and head coupling bosses 146 for preventing leakage of the liquid during operation of the pump 100. Head assembly 106 ports the fluid through the pump 100 where the pressure and/or flow rate of the fluid is increased from a first pressure and/or flow rate to a second pressure and/or flow rate. As shown in FIG. 2, the head assembly 106 includes an inlet or low pressure portion 180 having a connector 182 such as a conventional garden hose connector, or the like for coupling the pump 100 to a source of fluid, for example, household tap water, at a first pressure and/or flow rate. The head assembly 106 also includes an outlet or high pressure portion 184 for supplying the liquid at a second pressure and/or flow rate.

In exemplary embodiments, the head assembly 106 may include a pressure unloader valve 186 for regulating pressure supplied by the pump and a thermal relief valve 188 to relieve excess pressure caused by thermal stresses. An injector assembly 190 may be provided for injecting a substance, for example, soap, into the fluid supplied by the outlet portion 184. A dampener hose 192 may be coupled to the outlet portion 184. The dampener hose 192 expands and lengthens to absorb pressure pulsations in the fluid induced by pumping. Alternately, other devices such as a spring piston assembly or the like may be employed instead of the dampener hose 192 to absorb pressure pulsations and substitution of such devices by those of ordinary skill in the art would not depart from the scope and spirit of the present invention.

Head assembly 106 may farther include an integral start valve 194 for circulating the fluid within the head assembly 106 between the inlet portion 180 and the outlet portion 184 as the pump is started. The function of start valve 194 is described in co-pending U.S. patent application Ser. No. 09/639,435, filed Aug. 14, 2000, which is incorporated herein by reference in its entirety.

Figure 4A:
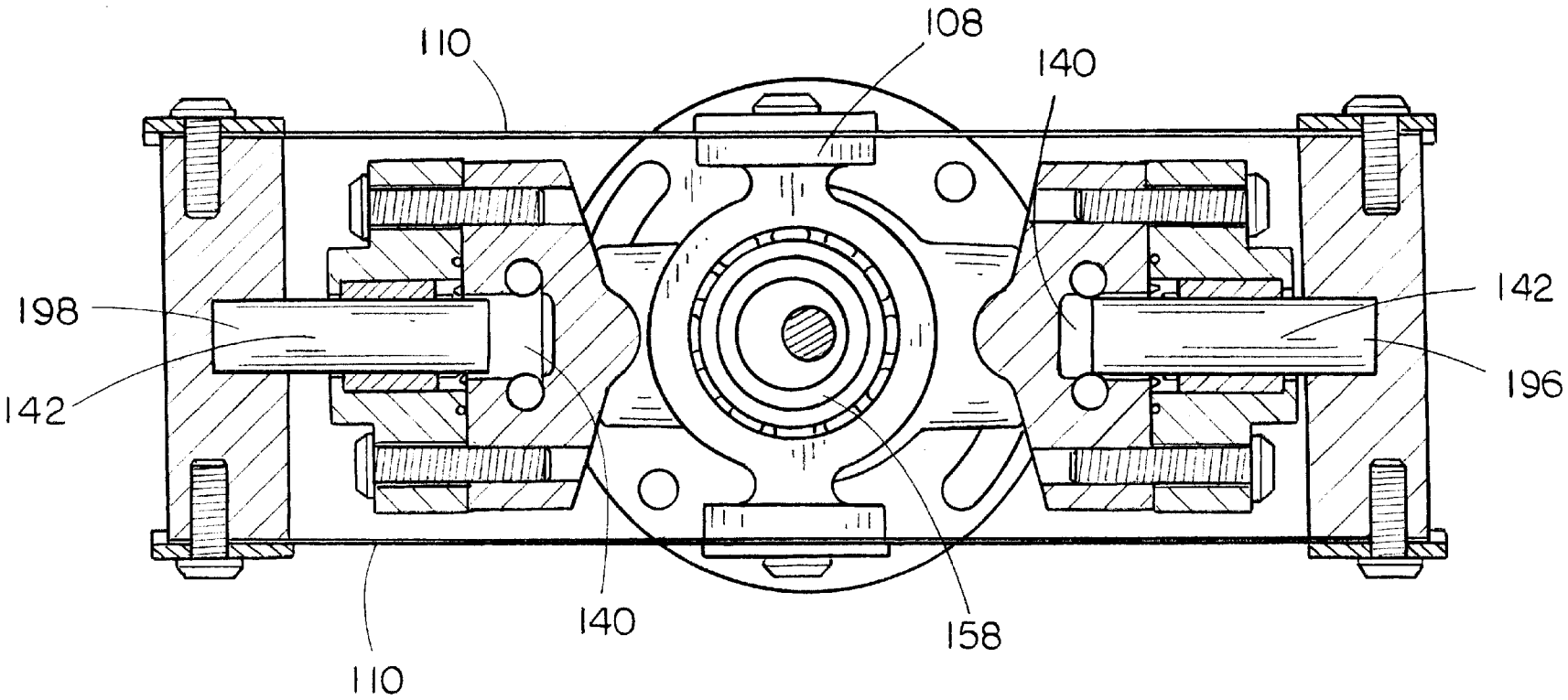
FIGS. 4A and 4B are a cross-sectional views of the pump shown in FIG. 1, further illustrating the pump's eccentric assembly.
Figure 4B:
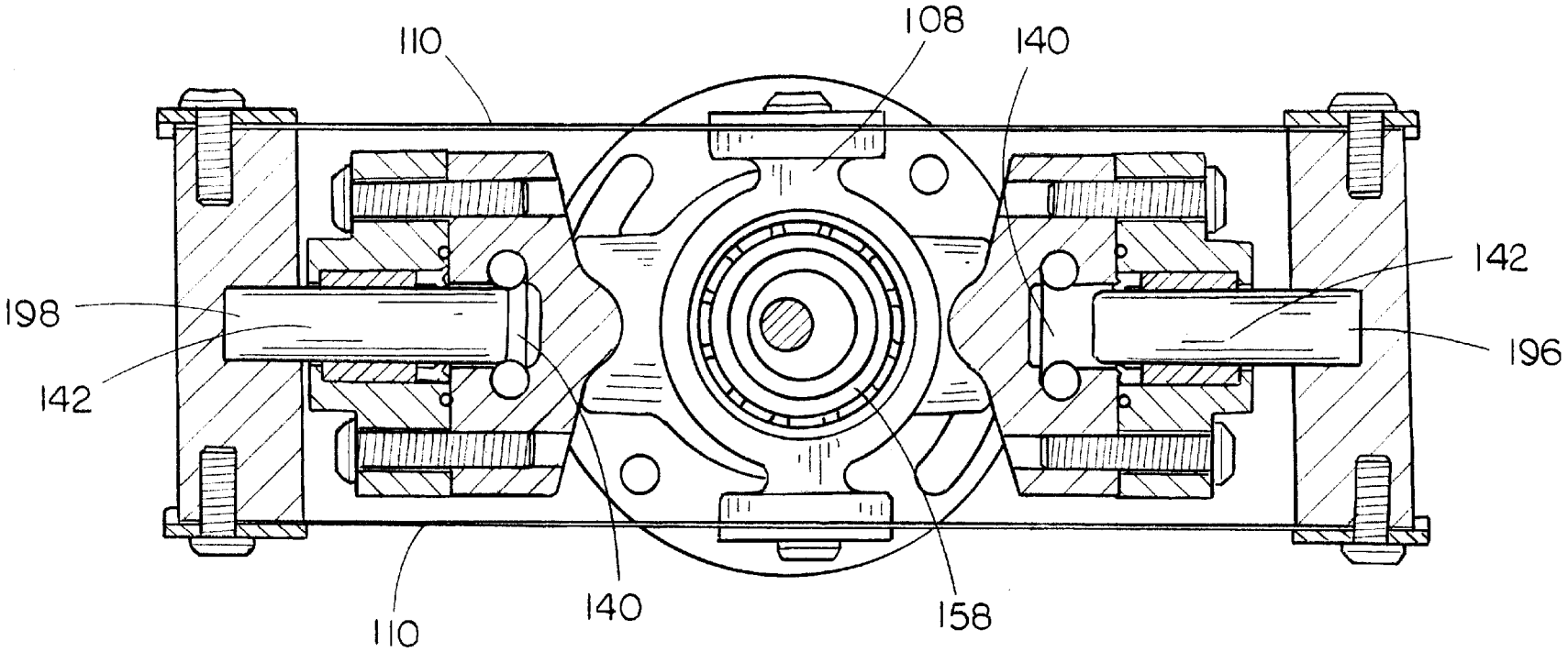

Referring now to FIGS. 4A and 4B, operation of the pump 100 is described. In the exemplary embodiment shown, the pump 100 includes axi-linearly opposed first and second piston assemblies 196 & 198. As shaft 130 (FIGS. 2 and 3) is turned by an engine, ring bearing assembly 160 of eccentric assembly 108 is moved from side to side converting the shaft's rotary motion to rectilinear motion. This rectilinear motion is communicated to the piston assemblies 104 by straps 110 for reciprocating pistons 142. Thus, as shown in FIG. 4A, as first piston assembly 196 undergoes a compression or pumping stroke for pumping the fluid thereby increasing its pressure and/or flow rate, second piston assembly 198 undergoes an intake stroke allowing fluid to be drawn into the piston assembly's cylinder 140. Consequently, the portions of straps 110 extending between the ring bearing assembly 160 and first piston assembly 196 are generally placed in compression, while the portions of straps 110 extending between the ring bearing assembly 160 and second piston assembly 198 are generally placed in tension.

Similarly, as shown in FIG. 4B, as second piston assembly 198 undergoes a compression or pumping stroke, first piston assembly 196 undergoes an intake stroke allowing fluid to be drawn into the piston assembly's cylinder 140. Thus, the portions of straps 110 extending between the ring bearing assembly 160 and second piston assembly 198 are generally placed in compression, while the portions of straps 110 extending between the ring bearing assembly 160 and first piston assembly 196 are generally placed in tension. Pump body 122 includes porting 148 providing inlet and outlet ports to cylinders 140 for porting the fluid into and out of the cylinders 140. Preferably, inlet ports 202 include valves (not shown) that shut during the compression strokes of their respective piston assemblies 196 & 198 to prevent back flow of the fluid into the inlet portion 180 of head assembly 106.

Preferably, the shape and thickness of flexible straps 110 are optimized to withstand the alternating bending and tension loads placed on them during operation of the pump 100. For example, in the exemplary embodiment shown in FIGS. 1 through 4B, each strap is comprised of a thin strip of steel having a generally double hourglass shape that widens adjacent to points of attachment of the strap 110 to the strap coupling members 150 and ring bearing assembly 160. This shape allows the strap 110 to flex and bend as piston assemblies 104 are reciprocated, and to distribute loads throughout the strap 110 more evenly. Straps 110 and bearing assemblies 118 & 128 are further described in co-pending U.S. patent application Ser. No. 09/639,573, filed Aug. 14, 2000, which is incorporated herein by reference in its entirety.

Figure 5:
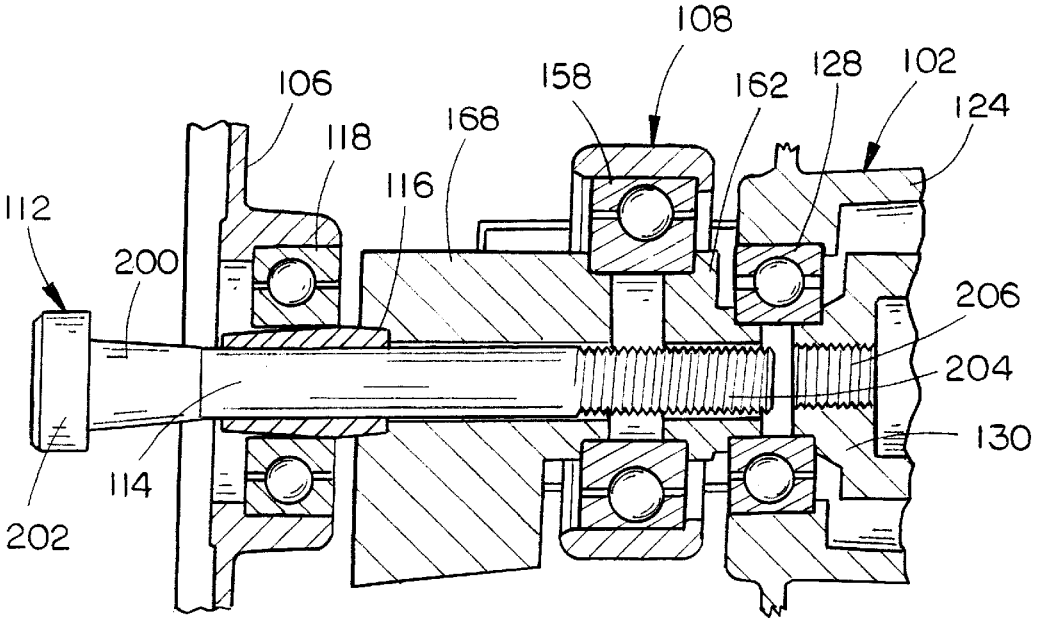
FIGS. 5 and 6 are cross-sectional views of the pump shown in FIG. 1, further illustrating capture of the bearing assembly by the apparatus of the present invention.
Figure 6:
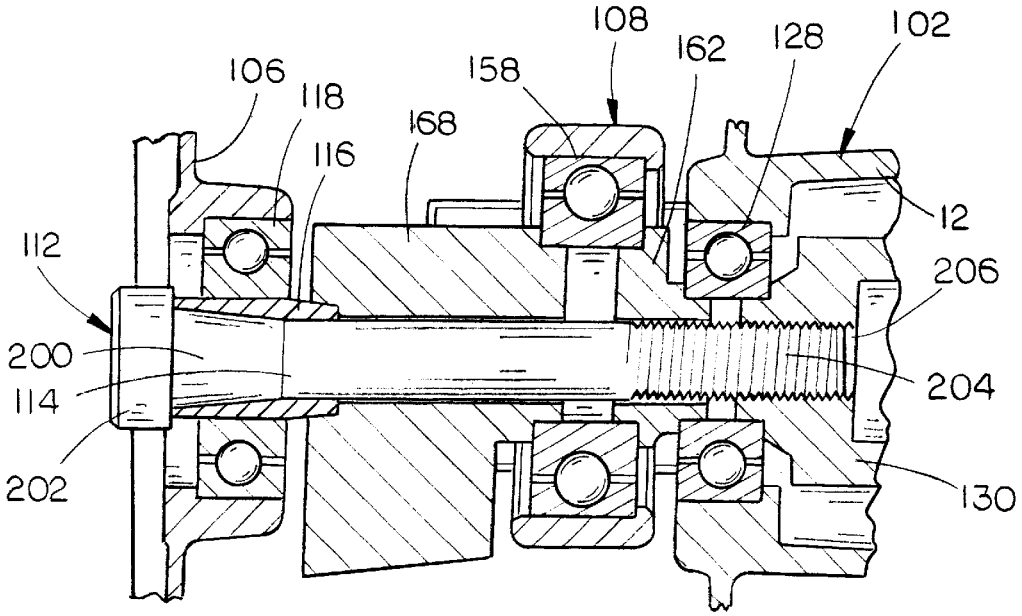

Turning now to FIGS. 5 and 6, capture of bearing assembly 118 by bearing capture apparatus 112 is described. In the exemplary embodiment shown, fastener 114 of bearing capture apparatus 112 includes a tapered portion 200, a head portion 202 adjacent to the tapered portion 200, and a threaded end 204 opposite the head portion 202 and tapered portion 200. As shown, the fastener 114 extends through bearing assembly 118, counterweight 168, ring bearing assembly 160, bearing coupling member 162, and bearing assembly 118, whereupon threaded end 204 is screwed into a threaded hole 206 formed in shaft 130 to clamp the components of the eccentric assembly 108 together. Preferably, fastener 114 is off-centered in bearing coupling member 162 so that the ring bearing assembly 160 is positioned axially off-center with respect to the center of shaft 130 allowing the eccentric 158 to convert the rotary motion of the shaft 130 to rectilinear motion that is communicated to the piston assemblies 104 by straps 110 for reciprocating pistons 142.

Collet 116 is disposed in bearing assembly 118 around the fastener 114. As fastener 114 is threaded into shaft 130, as shown in FIG. 5, tapered portion 200 is forced into collet 116, at least partially expanding or spreading the collet 116 within bearing assembly 118 as shown in FIG. 6. Expansion of the collet 116 causes the collet 116 to engage the bearing assembly 118 capturing the bearing assembly 118. Preferably, head portion 202 holds the collet 116 within the bearing assembly 118 and engages the outer surface of bearing assembly 118 for clamping the components of the eccentric assembly 108 together. Head portion 202 may also provide a means of gripping the fastener 114 so that it may be threaded into shaft 130.

In exemplary embodiments of the invention, tapered portion 200 of fastener 114 may have a generally conical cross-section. However, it will be appreciated that tapered portion 200 may have other cross-sections, such as, for example, faceted, curved or curvilinear cross-sections, as contemplated by one of ordinary skill in the art without departing from the scope and spirit of the invention. Further, as shown in FIG. 2, collet 116 may include one or more longitudinally formed slits for aiding expansion of the collet 116 and for allowing the collet to expand substantially uniformly in all axial directions.

It is believed that the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. An apparatus for capturing a bearing assembly to a shaft, comprising:

a fastener for securing said shaft to said bearing assembly, said fastener including a tapered portion; and a collet suitable for being disposed in said bearing assembly around said fastener;

wherein said tapered portion at least partially expands said collet so that said collet engages said bearing assembly for securing said bearing assembly to said shaft assembly.

2. The apparatus as claimed in claim 1, wherein said tapered portion is conical.

3. The apparatus as claimed in claim 1, wherein expansion of said collet by said fastener provides a predetermined amount of pre-load on said bearing assembly.

4. The apparatus as claimed in claim 1, wherein said fastener further comprises:

a head portion adjacent to said tapered portion, said head portion being suitable for holding said collet within said bearing assembly; and a threaded end opposite said head portion, said threaded end being suitable for engaging said shaft assembly.

5. A pump for pumping a liquid, comprising;

an eccentric assembly having a shaft suitable for being coupled to an engine, a bearing assembly for supporting said shaft so that said shaft may rotate wherein the rotary motion of said shaft operates said pump;

a fastener for securing said shaft assembly to said bearing assembly, said fastener including a tapered portion; and a collet disposed in said bearing assembly around said fastener;

wherein said tapered portion at least partially expands said collet so that said collet engages said bearing assembly for securing said bearing assembly to said shaft assembly.

6. The pump as claimed in claim 5, wherein said tapered portion is conical.

7. The pump as claimed in claim 5, wherein expansion of said collet by said fastener provides a predetermined amount of pre-load on said bearing assembly.

8. The pump as claimed in claim 5, wherein said fastener further comprises:

a head portion adjacent to said tapered portion, said head portion being suitable for holding said collet within said bearing assembly; and a threaded end opposite said head portion, said threaded end being suitable for engaging said shaft assembly.

9. The pump as claimed in claim 5, further comprising:

a piston assembly; and a flexible strap for coupling said eccentric assembly and said piston assembly;

wherein said strap is suitable for communicating the rectilinear motion of said eccentric assembly to said piston assembly for reciprocating said piston to pump said liquid.

10. The pump as claimed in claim 9, wherein said eccentric assembly further comprises a counterweight assembly for counterbalancing said piston assembly.

11. The pump as claimed in claim 10, wherein said strap is shaped so that loads within the strap are distributed substantially uniformly throughout the strap.

12. The pump as claimed in claim 5, wherein said bearing assembly comprises a scaled bearing.

13. A pressure washer, comprising:

an engine;

a pump including:

an eccentric assembly having a shaft suitable for being coupled to said engine, a bearing assembly for supporting said shaft so that said shaft may rotate wherein the rotary motion of said shaft operates said pump;

a fastener for securing said shaft assembly to said bearing assembly, said fastener including a tapered portion; and a collet disposed in said bearing assembly around said fastener;

wherein said tapered portion at least partially expands said collet so that said collet engages said bearing assembly for securing said bearing assembly to said shaft assembly.

14. The pressure washer as claimed in claim 13 wherein said tapered portion is conical.

15. The pressure washer as claimed in claim 13, wherein expansion of said collet by said fastener provides a predetermined amount of pre-load on said bearing assembly.

16. The pressure washer as claimed in claim 14, wherein said fastener further comprises:

a head portion adjacent to said tapered portion, said head portion being suitable for holding said collet within said bearing assembly; and a threaded end opposite said head portion, said threaded end being suitable for engaging said shaft assembly.

17. The pressure washer as claimed in claim 13, wherein said pump further comprises:

a piston assembly; and a flexible strap for coupling said eccentric assembly and said piston assembly;

wherein said strap is suitable for communicating the rectilinear motion of said eccentric assembly to said piston assembly for reciprocating said piston to pump said liquid.

18. The pressure washer as claimed in claim 17, wherein said eccentric assembly further comprises a counterweight assembly for counterbalancing said piston assembly.

19. The pump as claimed in claim 17, wherein said strap is shaped so that loads within the strap are distributed substantially uniformly throughout the strap.

20. The pump as claimed in claim 13, wherein said bearing assembly comprises a sealed bearing.

* * * * *